US010641284B2

(12) United States Patent
Pirouzpanah et al.

(10) Patent No.: US 10,641,284 B2
(45) Date of Patent: May 5, 2020

(54) CENTRIFUGAL BLOWER ASSEMBLIES HAVING A PLURALITY OF AIRFLOW GUIDANCE FINS AND METHOD OF ASSEMBLING THE SAME

(71) Applicant: Regal Beloit America, Inc., Beloit, WI (US)

(72) Inventors: Sahand Pirouzpanah, Miamisburg, OH (US); Shradha S. Nahar, Milwaukee, WI (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 359 days.

(21) Appl. No.: 15/454,593

(22) Filed: Mar. 9, 2017

(65) Prior Publication Data

US 2018/0258948 A1 Sep. 13, 2018

(51) Int. Cl.

| | |
|---|---|
| ***F04D 29/44*** | (2006.01) |
| ***F04D 17/16*** | (2006.01) |
| ***F04D 25/08*** | (2006.01) |
| ***F04D 29/62*** | (2006.01) |
| ***F04D 29/28*** | (2006.01) |

(52) U.S. Cl.

CPC ..... *F04D 29/441* (2013.01); *F04D 17/16* (2013.01); *F04D 17/162* (2013.01); *F04D 25/08* (2013.01); *F04D 29/283* (2013.01); *F04D 29/444* (2013.01); *F04D 29/626* (2013.01); *F05D 2250/51* (2013.01)

(58) Field of Classification Search

CPC .. F04D 29/4213; F04D 29/424; F04D 29/441; F04D 17/16; F04D 17/162; F04D 25/08; F04D 29/283; F04D 29/444; F04D 29/626

See application file for complete search history.

(56) References Cited

U.S. PATENT DOCUMENTS

| | | | | |
|---|---|---|---|---|
| 4,828,456 | A * | 5/1989 | Bodzian | F04D 29/444 415/209.1 |
| 5,951,245 | A * | 9/1999 | Sullivan | F04D 29/681 415/121.2 |
| 6,092,988 | A * | 7/2000 | Botros | F04D 29/667 415/191 |
| 6,964,555 | B2 | 11/2005 | Ochiai et al. | |
| 7,108,482 | B2 | 9/2006 | Chapman | |
| 7,351,031 | B2 | 4/2008 | Horng et al. | |
| 7,497,659 | B2 * | 3/2009 | Hsu | F04D 29/4213 415/183 |
| 8,072,754 | B2 | 12/2011 | Zhang et al. | |

(Continued)

*Primary Examiner* — Kenneth J Hansen
*Assistant Examiner* — Eric J Zamora Alvarez
(74) *Attorney, Agent, or Firm* — Armstrong Teasdale LLP

(57) ABSTRACT

A centrifugal blower assembly includes a housing and a blower wheel coupled to the housing. The blower wheel includes a plurality of blades circumferentially-spaced about an axis of rotation. Each blade includes a length and is oriented at a first angle along the length with respect to the rotational axis. The centrifugal blower assembly also includes a plurality of circumferentially-spaced fins coupled in flow communication with said blower wheel, said plurality of fins configured to direct an inlet airflow into the blower wheel such that a relative velocity direction of the inlet airflow is oriented at the first angle with respect to the rotational axis.

19 Claims, 14 Drawing Sheets

(56) References Cited

U.S. PATENT DOCUMENTS

| | | | | |
|---|---|---|---|---|
| 8,517,012 | B2 * | 8/2013 | Daly | A61M 16/0057 128/204.18 |
| 9,441,642 | B2 * | 9/2016 | Rao | F04D 29/162 |
| 2006/0051203 | A1 | 3/2006 | Lee et al. | |
| 2008/0219836 | A1 * | 9/2008 | Decker | F04D 29/542 415/177 |
| 2012/0171032 | A1 | 7/2012 | Goenka | |

* cited by examiner

CENTRIFUGAL BLOWER ASSEMBLIES HAVING A PLURALITY OF AIRFLOW GUIDANCE FINS AND METHOD OF ASSEMBLING THE SAME

BACKGROUND

The field of the disclosure relates generally to an inlet ring for a centrifugal blower assembly, and more specifically, an inlet ring for a centrifugal blower assembly that include fins to enhance blower assembly efficiency.

Centrifugal blower or fan systems are commonly used in the automotive, air handling, and ventilation industries for directing large volumes of forced air, over a wide range of pressures, through a variety of air conditioning components. In some known centrifugal blower systems, air is drawn into a housing through one or more inlet openings by a rotating wheel. The rotating wheel forces the air around the housing and out an outlet end. Some known housings include an inlet ring to provide stiffness to the housing to reduce vibrations. Some known centrifugal blower assemblies receive inlet air into the rotating wheel over the inlet ring at angles that do not optimize the efficiency of the rotating wheel.

BRIEF DESCRIPTION

In one aspect, an inlet ring for use in a centrifugal blower assembly including an axis of rotation is provided. The inlet ring includes a ring portion including a first end, a second end, and a ring body extending therebetween. The inlet ring also includes a plurality of fins coupled to the ring body. The plurality of fins are circumferentially-spaced about the ring body and each fin of the plurality of fins includes a leading edge, a trailing edge, and a fin body extending therebetween.

In another aspect, a centrifugal blower assembly is provided. The centrifugal blower assembly includes a housing and a blower wheel coupled to the housing. The blower wheel includes a plurality of blades circumferentially-spaced about an axis of rotation. Each blade includes a length and is oriented at a first angle along the length with respect to the rotational axis. The centrifugal blower assembly also includes a plurality of circumferentially-spaced fins coupled in flow communication with said blower wheel, said plurality of fins configured to direct an inlet airflow into the blower wheel such that a relative velocity direction of the inlet airflow is oriented at the first angle with respect to the rotational axis.

In another aspect, a method of assembling a centrifugal blower assembly is provided. The method includes coupling a blower wheel to a housing. The blower wheel includes a plurality of blades circumferentially-spaced about an axis of rotation. Each blade includes a length and is oriented at a first angle along the length with respect to the rotational axis. The method also includes coupling an inlet ring to the housing such that the inlet ring defines a housing inlet. The method further includes coupling a plurality of circumferentially-spaced fins about the inlet ring such that the plurality of fins are configured to direct an inlet airflow into the blower wheel such that the inlet airflow includes a relative velocity direction oriented at the first angle with respect to the rotational axis.

Although specific features of various embodiments may be shown in some drawings and not in others, this is for convenience only. Any feature of any drawing may be referenced and/or claimed in combination with any feature of any other drawing.

DETAILED DESCRIPTION

The apparatus, methods, and systems described herein provide a centrifugal blower assembly having increased efficiency, reduced noise, and an improved airflow distribution at the blower outlet opening. Specifically, the centrifugal blower assembly described herein includes an inlet ring having a plurality of circumferentially-spaced fins. These fins change the direction of the airflow entering the inlet of the blower wheel to increase the efficiency of the blower wheel. More specifically, the inlet ring fins change the direction of the airflow such that the direction of the relative velocity of the airflow matches the direction of the blower wheel blades with respect to the axis of rotation. Aligning the relative velocity of the airflow entering the blower wheel with the direction of the blower wheel blades enables the blower wheel to interact with a maximum amount of air and channel more air through the outlet.

As used herein, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

Figure 1:
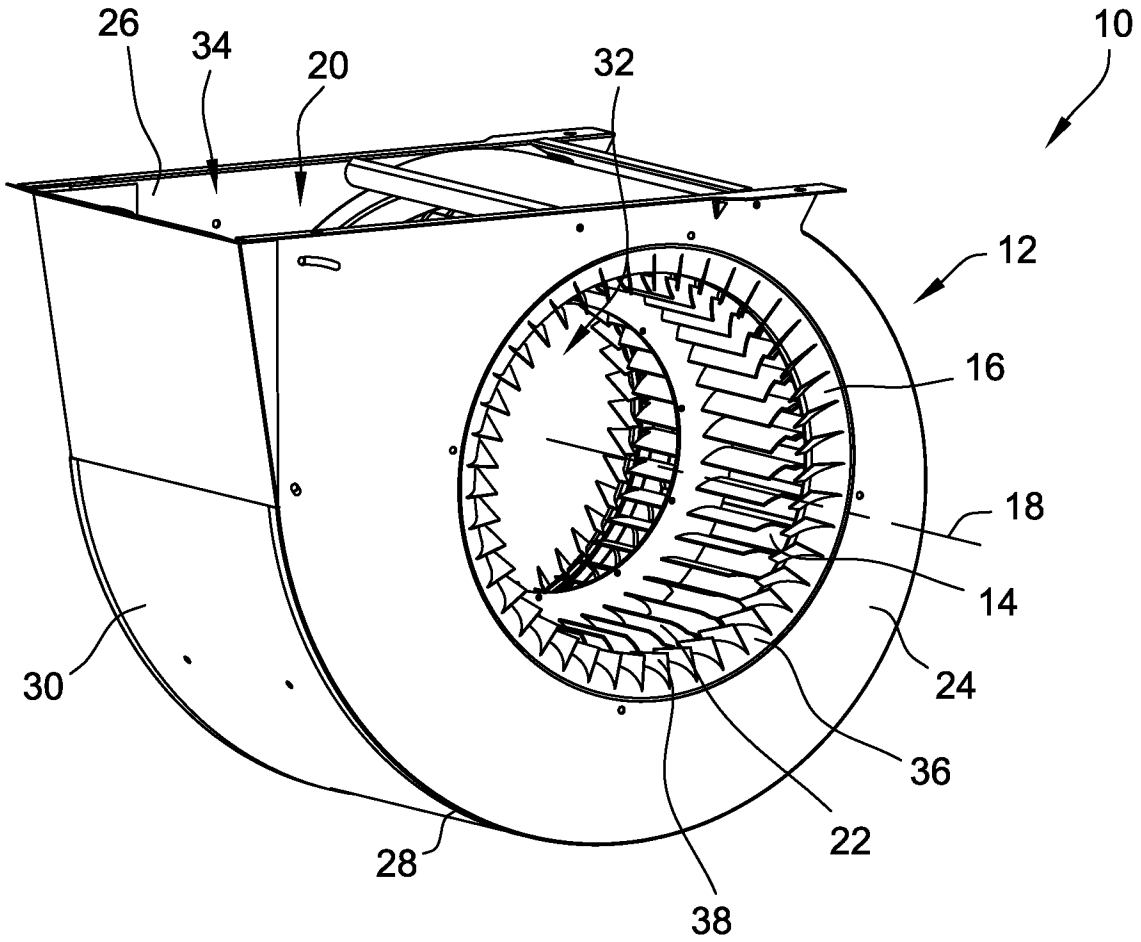
FIG. 1 is a perspective view of an exemplary centrifugal blower assembly illustrating a housing, a wheel, and an inlet ring.
Figure 2:
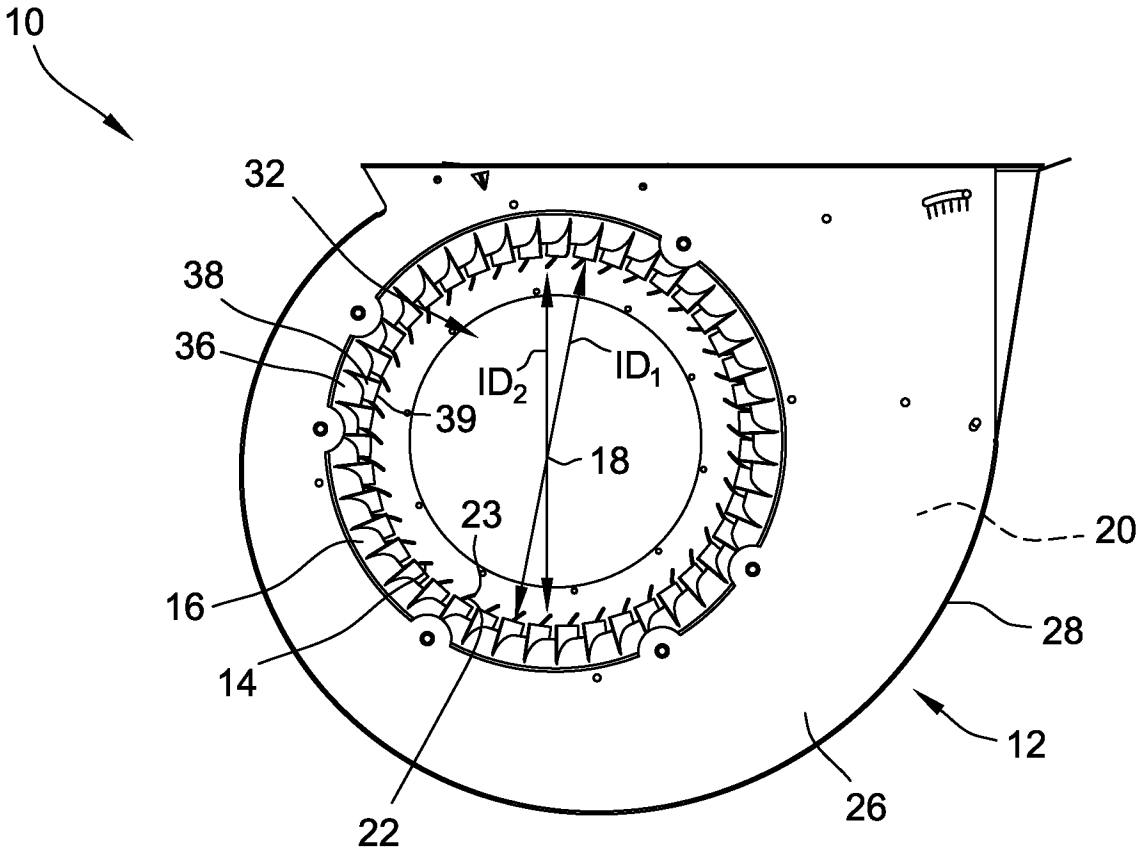
FIG. 2 is a side view of the centrifugal blower assembly shown in FIG. 1.

FIG. 1 is a perspective view of an exemplary centrifugal blower assembly 10 illustrating a housing 12, a blower wheel 14, and an inlet ring 16. FIG. 2 is a side view of centrifugal blower assembly 10. As seen in FIG. 2, centrifugal blower assembly 10 includes blower wheel 14 coupled to housing 12 and having an axis of rotation 18. Blower wheel 14 is coupled to a motor (not shown in FIGS. 1 and 2), which is configured to rotate blower wheel 14 about axis of rotation 18. The rotation of blower wheel 14 draws air into housing 12 along axis of rotation 18 and expels the air radially outward into a chamber 20 defined by housing 12. In the exemplary embodiment, blower wheel 14 is formed from a plurality of forward curved, circumferentially-spaced, fan blades 22. Alternatively, blower wheel 14 may include backward curved blades, airfoil blades, backward inclined blades, radial blades, or any other suitable blade shape that enables blower wheel 14 to operate as described herein. In the exemplary embodiment, the shape of fan blades 22 of blower wheel 14 facilitates reducing operating noise and increasing the efficiency of blower wheel 14. Blower wheel 14 is configured to produce a flow of air for a forced air system, e.g., without limitation, a residential HVAC system.

In the exemplary embodiment, housing 12 includes a first sidewall 24 and an opposite second sidewall 26 that are fabricated as generally flat, parallel sidewalls disposed at axially opposite ends of blower wheel 14. An outer periphery 28 of each of sidewalls 24 and 26 is shaped substantially the same and generally forms a volute shape with respect to axis of rotation 18. In the exemplary embodiment, a volute outer wall 30 is coupled between sidewalls 24 and 26. More specifically, volute outer wall 30 is coupled to outer periphery 28 of sidewalls 24 and 26 thereby forming an increasing expansion angle for airflow through housing 12.

In the exemplary embodiment, an inlet ring 16 is coupled to each of sidewall 24 and 26 of housing 12 defines an air inlet opening 32 provided in each of sidewalls 24 and 26. In other embodiments, as described in further detail below, assembly 10 includes only a single inlet ring 16 coupled to one of sidewall 24 or 26. Further, an air outlet opening 34 is defined, at least in part, by sidewalls 24 and 26, and volute outer wall 30 such that airflow is expelled from centrifugal blower housing 12 through air outlet opening 34.

As shown in FIGS. 1 and 2, inlet ring 16 includes a ring portion 36 and a plurality of fins 38 coupled to ring portion 36. More specifically, ring portion 36 is coupled to sidewall 24 or 26 and fins 38 are circumferentially-spaced about ring portion 36 and define inlet 32. As described in further detail below, fins 38 change the direction of airflow entering blower wheel 14 through inlet 32 such that the direction of the relative velocity of the airflow matches the alignment of the blades 22 of blower wheel 14 to optimize the efficiency of blower wheel 14. As best shown in FIG. 2, each fin 38 includes a radially inner edge 39 that together define an inner diameter ID1 of inlet ring 16. Similarly, each blade 22 includes a radially inner edge 23 that together define an inner diameter ID2 of blower wheel 14 that is less than inner diameter ID1 of inlet ring 16.

In operation, blower wheel 14 rotates about axis of rotation 18 to draw air into housing 12 through air inlet opening 32. The amount of air moved by centrifugal blower assembly 10 increases as a point on blower wheel 14 moves within housing 12 towards air outlet opening 34. Volute outer wall 30 is positioned progressively further away from blower wheel 14 in the direction of rotation of blower wheel 14 to accommodate the increasing volume of air due to the volute shape of housing 12. Blower wheel 14 generates high velocity airflow that is exhausted from air outlet opening 34. Blower wheel 14 draws airflow into chamber 20 through air inlet opening 32 and passed fins 38 of inlet ring 16 to guide the airflow into blower wheel 14 in an optimum direction. Blower wheel 14 turns airflow to a generally radial direction (referring to a radial direction generally perpendicular to axis of rotation 18) and exhausts airflow through outlet opening 34.

Figure 3:
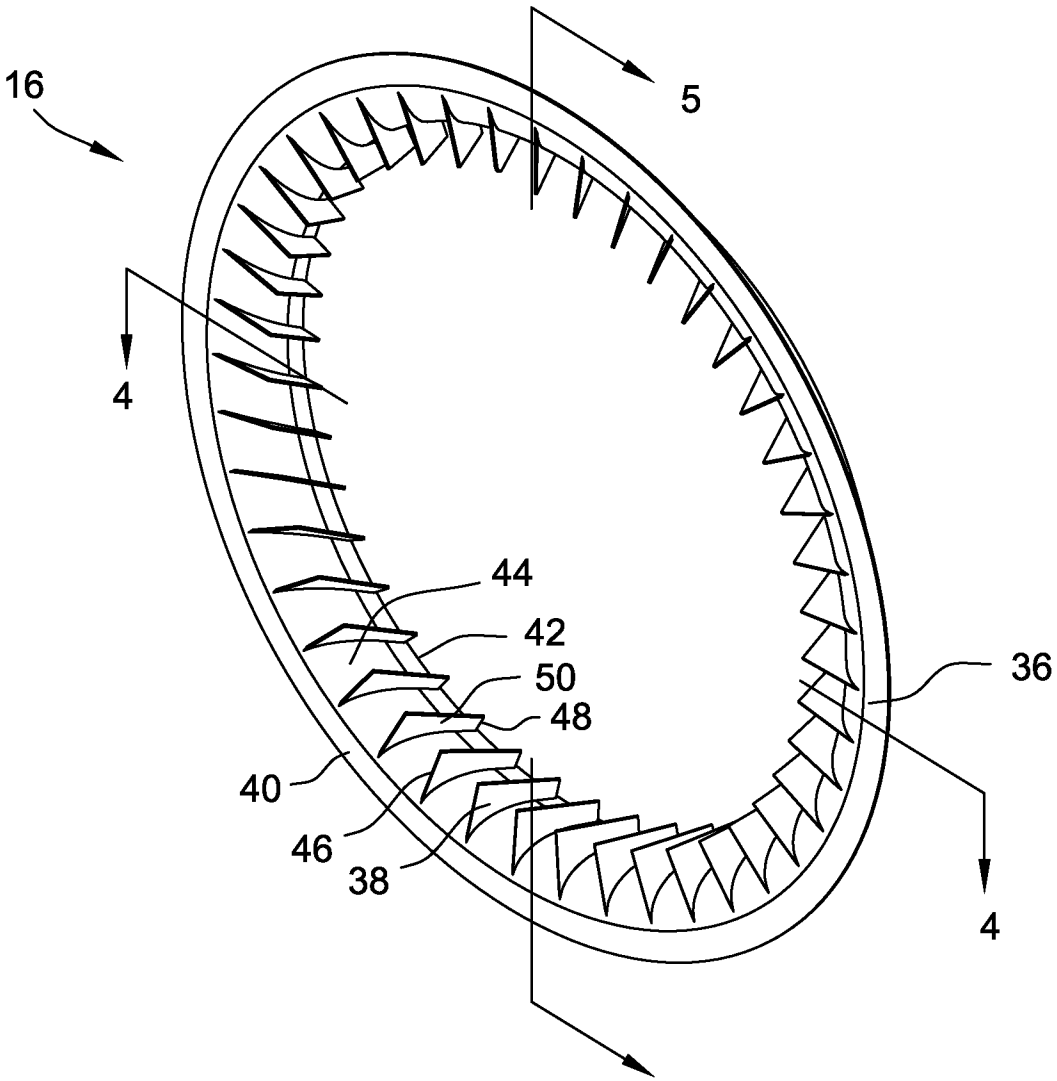
FIG. 3 is a perspective view of an exemplary inlet ring for use in the centrifugal blower assembly shown in FIG. 1.
Figure 4:
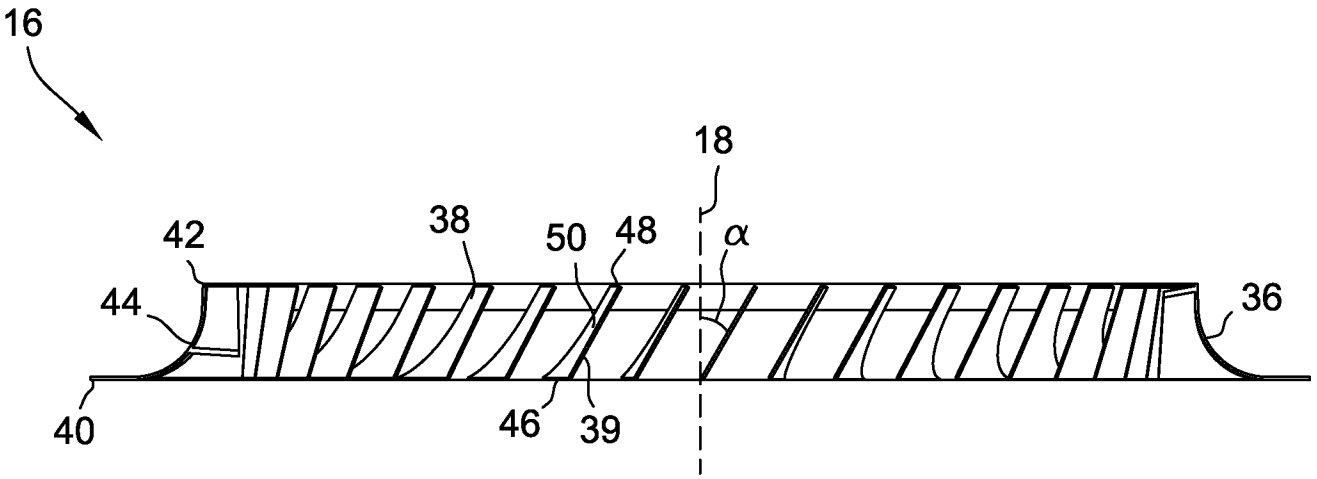
FIG. 4 is a cross-sectional view of the inlet ring shown in FIG. 3 taken along line 4-4 in FIG. 3.
Figure 5:
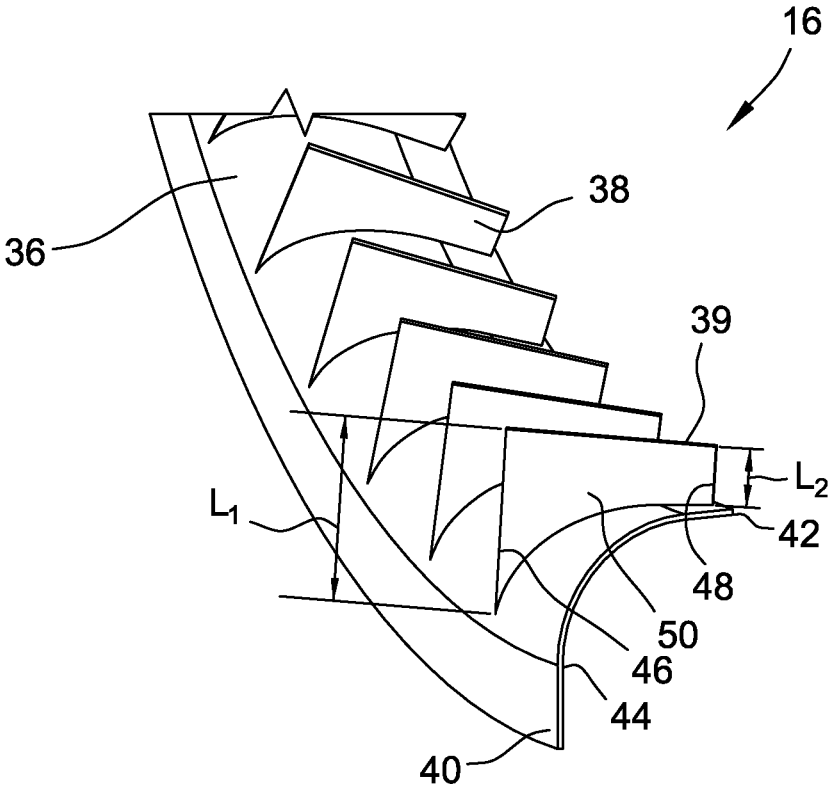
FIG. 5 is a cross-sectional view of the inlet ring shown in FIG. 3 taken along line 5-5 in FIG. 3.

FIG. 3 is a perspective view of inlet ring 16 for use in centrifugal blower assembly 10 (shown in FIG. 1). FIG. 4 is a cross-sectional view of inlet ring 16 taken along line 4-4 in FIG. 3. FIG. 5 is a cross-sectional view of inlet ring 16 taken along line 5-5 in FIG. 3. In the exemplary embodiment, inlet ring 16 includes ring portion 36 and plurality of fins 38 circumferentially-spaced about ring portion 36. More specifically, ring portion 36 includes a first end 40, a second end 42, and a ring body 44 extending therebetween. Similarly, each fin 38 includes a leading edge 46 positioned proximate first end 40, a trailing edge 48 positioned proximate second end 42, and a fin body 50 extending between edges 46 and 48 and along ring body 44. As shown in FIG. 5, leading edge 46 includes a first length L1 and trailing edge 48 includes a second length L2 that is less than first length L1 of leading edge 46.

In the exemplary embodiment, inlet ring 16 is a separate component coupled to housing 12 and including fins 38. In another embodiment, inlet ring 16 is integrally formed with, and therefore a component of, housing 12. In another embodiment, assembly 10 does not include inlet ring 16 and fins 38 are coupled to housing 12. Generally, fins 38 are coupled to housing 12, inlet ring 16, or any other structure such that fins 38 are coupled in flow communication with blades 22 of blower wheel 14.

In the exemplary embodiment, plurality of fins 38 includes a number of fins 38 equal to $$\frac{(\pi S(ID))}{C},$$

wherein S is the solidity of fins 38, ID is inner diameter ID1 of inlet ring 16, and C is a chord length of each fin. Solidity is defined as the ratio of chord length to pitch of fin 38. Chord length is the distance between leading edge 46 and trailing edge 48, and pitch is the spacing between fins 38. In another embodiment, inlet ring 16 includes any number of fins 38 to facilitate operation of inlet ring 16 and assembly 10 as described herein.

In the exemplary embodiment, fin body 50 is planar, that is, linear, between leading edge 46 and trailing edge 48. Fin body 50 is also oriented at a pitch angle $\alpha$ that is oblique with respect to rotational axis 18. More specifically, fin body 50 is also oriented at angle $\alpha$ within a range of approximately 0 degrees and approximately 60 degrees with respect to rotational axis 18. Even more specifically, fin body 50 is also oriented at pitch angle $\alpha$ within a range of approximately 20 degrees and approximately 30 degrees with respect to rotational axis 18. In another embodiment, fin body 50 is oriented at any pitch angle $\alpha$ to facilitate operation of inlet ring 16 and assembly 10 as described herein.

Figure 6:
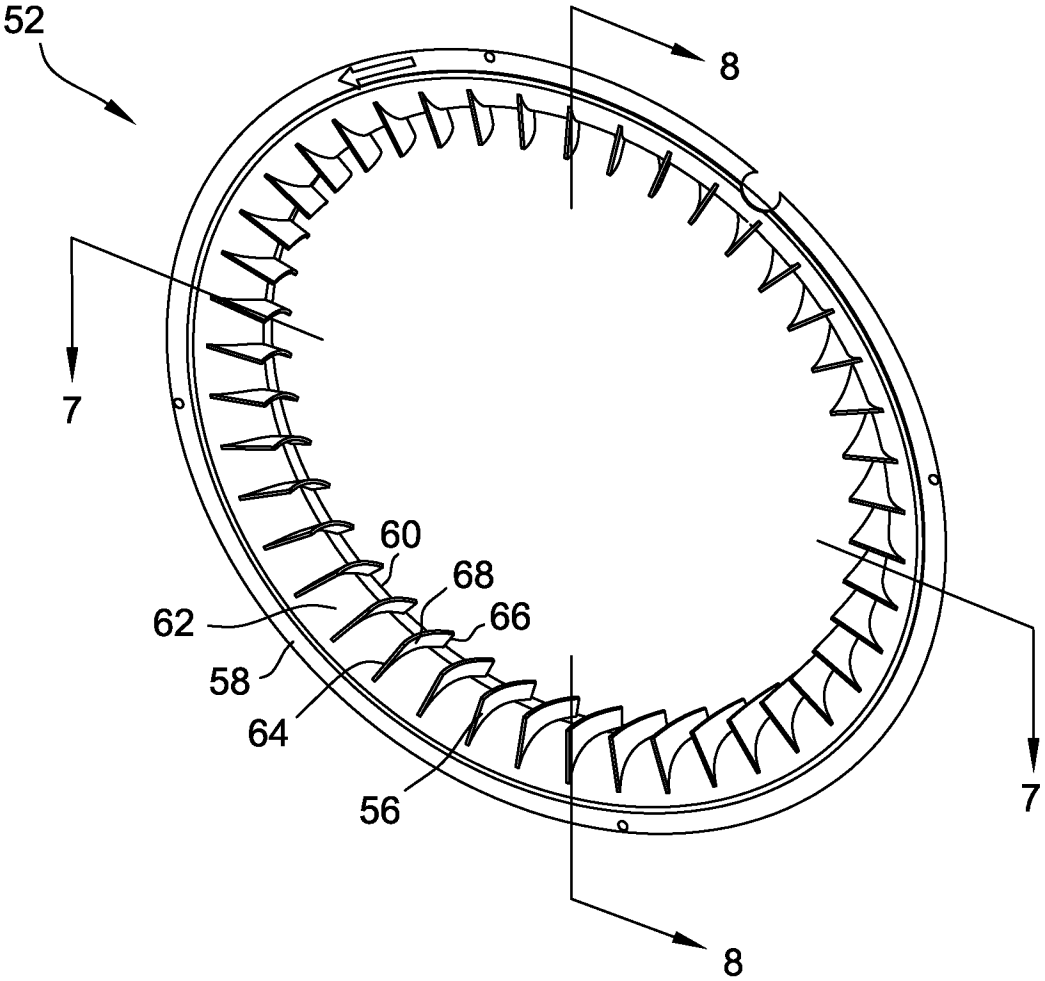
FIG. 6 is a perspective view of an alternative inlet ring for use in the centrifugal blower assembly shown in FIG. 1.
Figure 7:
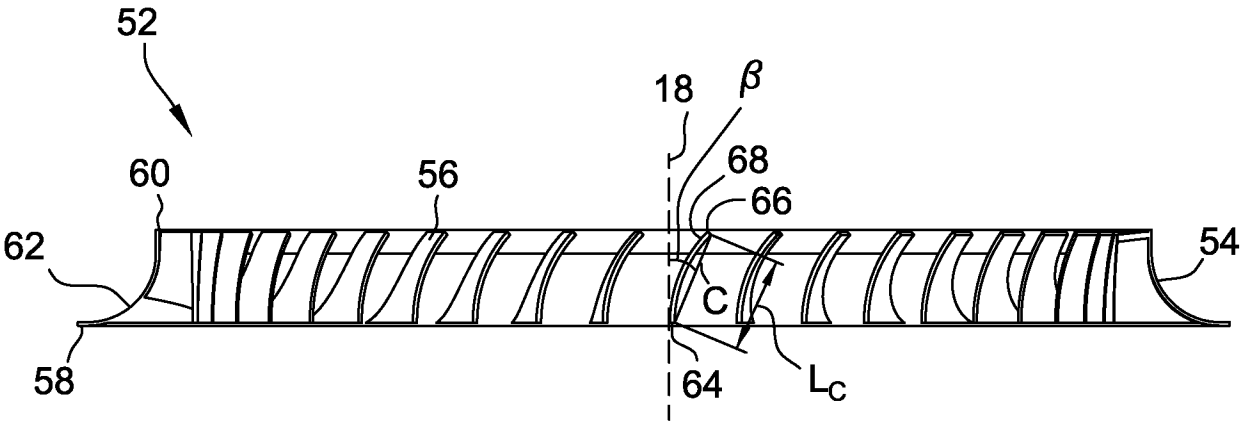
FIG. 7 is a cross-sectional view of the inlet ring shown in FIG. 6 taken along line 7-7 in FIG. 6.
Figure 8:
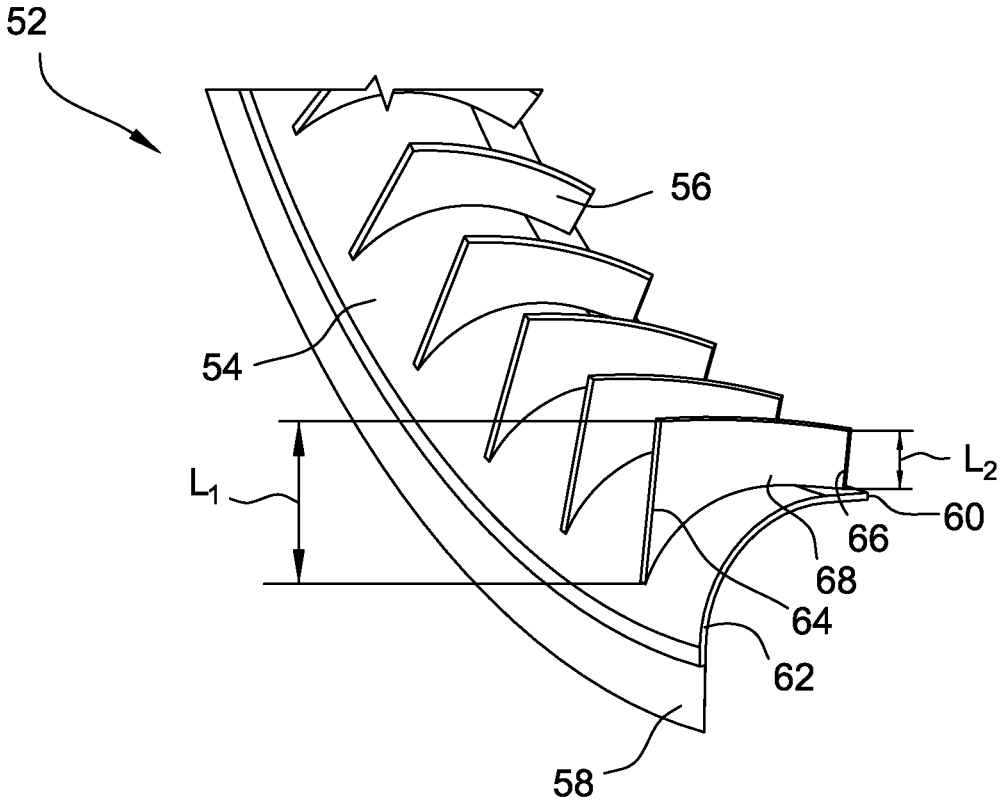
FIG. 8 is a cross-sectional view of the inlet ring shown in FIG. 6 taken along line 8-8 in FIG. 6.

FIG. 6 is a perspective view of an alternative inlet ring 52 for use in centrifugal blower assembly 10 (shown in FIG. 1). FIG. 7 is a cross-sectional view of inlet ring 52 taken along line 7-7 in FIG. 6. FIG. 8 is a cross-sectional view of inlet ring 52 taken along line 8-8 in FIG. 6. Inlet ring 52 includes a ring portion 54 and a plurality of fins 56 circumferentially-spaced about ring portion 54. More specifically, ring portion 54 includes a first end 58, a second end 60, and a ring body 62 extending therebetween. Similarly, each fin 56 includes a leading edge 64 positioned proximate first end 58, a trailing edge 66 positioned proximate second end 60, and a fin body 68 extending between edges 64 and 66 and along ring body 62. As shown in FIG. 8, leading edge 64 includes a first length L1 and trailing edge 66 includes a second length L2 that is less than first length L1 of leading edge 64.

Plurality of fins 56 includes a number of fins 56 equal to $$\frac{(\pi S(ID))}{C},$$

wherein S is the solidity of fins 56, ID is inner diameter ID1 of inlet ring 52, which is equal to ID1 of inlet ring 16, and C is a chord length of each fin. Solidity is defined as the ratio of chord length to pitch of fin 56. Chord length is the distance between leading edge 64 and trailing edge 66, and pitch is the spacing between fins 38. In another embodiment, inlet ring 52 includes any number of fins 56 to facilitate operation of inlet ring 52 and assembly 10 as described herein.

As shown in FIGS. 5-8, fin body 68 is curved, that is, non-linear, over its entire length between leading edge 64 and trailing edge 66 such that fin body 68 defines a chord line c between leading edge 64 and trailing edge 66. Chord line c is oriented at a pitch angle β that is oblique with respect to rotational axis 18. More specifically, fin body 68 is oriented at pitch angle β within a range of approximately 0 degrees and approximately 60 degrees with respect to rotational axis 18. Even more specifically, fin body 68 is oriented at pitch angle β within a range of approximately 20 degrees and approximately 30 degrees with respect to rotational axis 18. In another embodiment, fin body 68 is oriented at any pitch angle β to facilitate operation of inlet ring 52 and assembly 10 as described herein.

Figure 9:
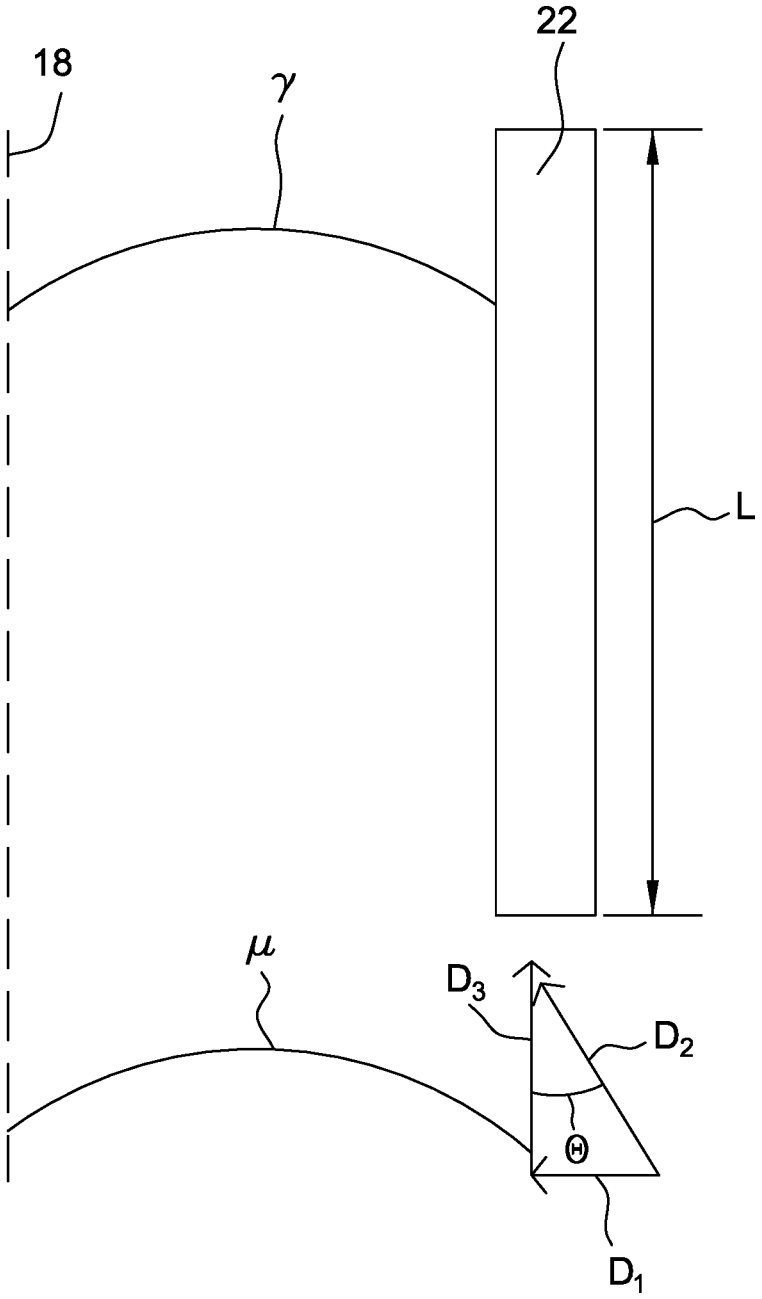
FIG. 9 is a top view of a blade of the blower wheel shown in FIG. 1.

FIG. 9 is a perspective view of a blade 22 of blower wheel 14 (shown in FIG. 1). As described in further detail herein, blower wheel 14 is a high efficiency impeller having longer (in a radial direction) blades 22 in comparison with conventional blower wheels. These long blades in high efficiency blower wheel 14 are more exposed to the axial flow entering blades 22 than standard blower wheels. To improve the efficiency further in high efficiency blower wheel 14, the angle of the blade 22 with respect to rotational axis 18 and the angle of the relative velocity of the airflow entering blades 22 is matched. As described herein, fins 38 and 56 on inlet rings 16 and 52 change the angle of the relative velocity of the airflow entering blades 22 with respect to the rotational axis 18 to ensure it matches with the angle of blades 22 with respect to the rotational axis 18.

As shown in FIG. 9, each blade 22 of blower wheel 14 includes a length L and is oriented at an angle γ along length L with respect to rotational axis 18. More specifically, in the exemplary embodiment, the angle γ of orientation of blade 22 is zero with respect to rotational axis 18 such that blade 22 is oriented parallel to rotational axis 18. In other embodiments, the angle γ of orientation of blade 22 is greater than zero and blade 22 oriented obliquely with respect to rotational axis 18.

In the exemplary embodiment, blower wheel 14 travels in a first direction D1 about rotational axis 18. Furthermore, fins 38 and 56 of inlet rings 16 and 52 direct an inlet airflow into blades 22 of blower wheel 14 in a second direction D2. As shown in FIG. 9, the relative velocity of the airflow is oriented in a third direction D3 (also referred to as relative velocity direction D3) such that an angle θ is formed between second direction D2 and relative velocity direction D3. Additionally, an angle μ is defined between relative velocity direction D3 and rotational axis 18. In the exemplary embodiment, angle μ of relative velocity direction D3 of the airflow is parallel to angle γ of orientation of blade 22 to increase the efficiency of blower wheel 14. More specifically, angle μ of relative velocity direction D3 is zero with respect to rotational axis 18 such that the relative velocity direction D3 of the inlet airflow is oriented parallel to rotational axis 18. In other embodiments, the angleμ of orientation of relative velocity direction D3 is greater than zero and relative velocity direction D3 is oriented obliquely with respect to rotational axis 18, and long as angleμ of relative velocity direction D3 is equal to angle γ of orientation of blade 22.

Figure 10:
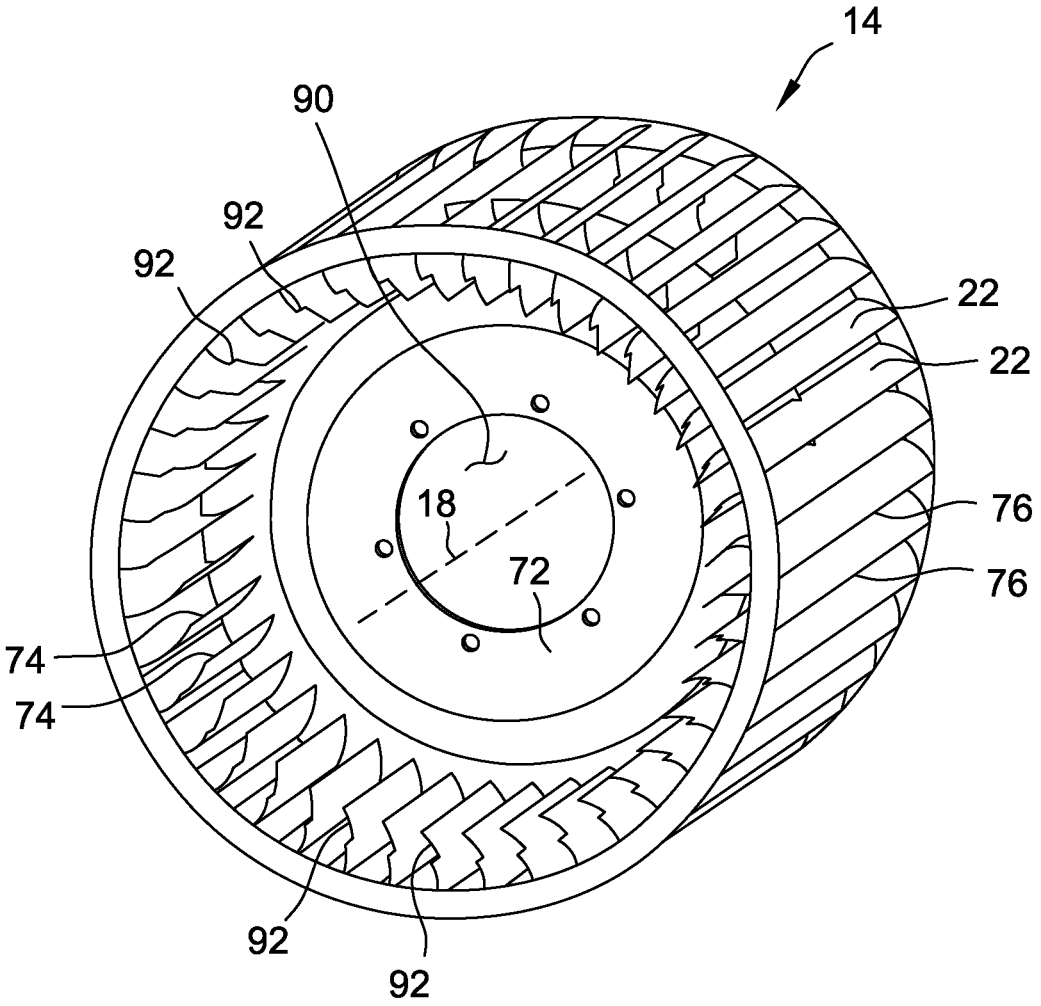
FIG. 10 is a perspective view of an exemplary blower wheel for use in the centrifugal blower assembly shown in FIG. 1.
Figure 11:
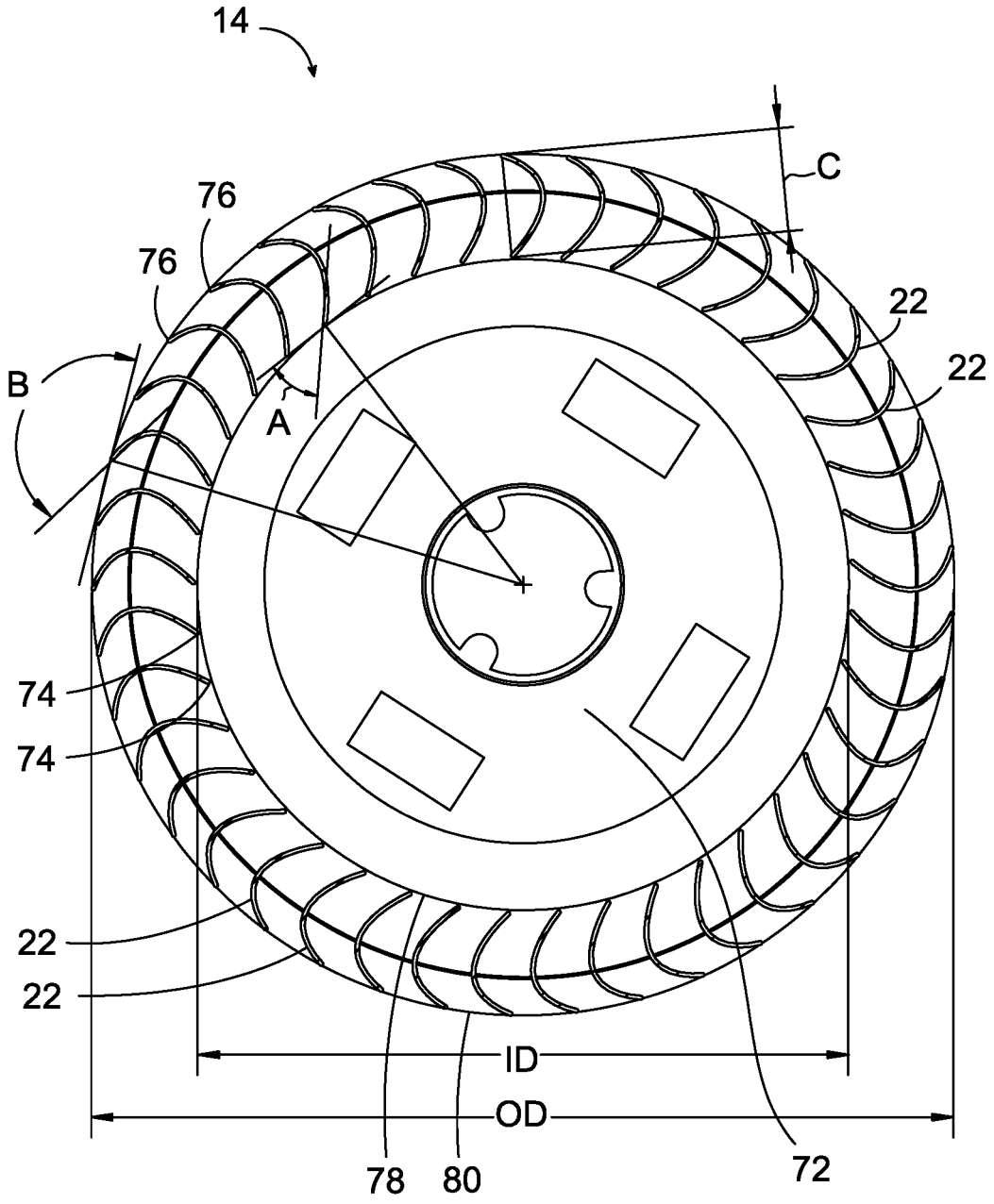
FIG. 11 is a cross-sectional view of the blower wheel shown in FIG. 10.

FIG. 10 is a perspective view of blower wheel 14 for use with centrifugal blower assembly 10 (shown in FIG. 1), and FIG. 11 is a cross-sectional view of forward-curved blower wheel 14. In general, blower wheel 14 includes the plurality of fan blades 22 that are circumferentially spaced about axis of rotation 18 and are coupled to at least one divider or end member 72. The divider or end member 72 may be an axial motor, a plate, a spoked wheel, or some other member that operatively connects a motor to fan blades 22 in a manner such that the motor is capable of revolving fan blades 22 about axis 18. Dual inlet blower assemblies 10 typically include a divider member 72 positioned between the opposite axial ends of the blower wheel 14. Single inlet blower assemblies (not shown) typically comprise an end member positioned at an axial end of the blower wheel 14.

Each fan blade 22 has a leading edge 74 and a trailing edge 76, with the distance therebetween being known as the chord length 78 (symbolized herein as "C") of fan blade 22. Between leading edge 74 and trailing edge 76, fan blade 22 curves along a non-linear path, which is referred to herein as the "mean camber line." The mean camber line has a blade angle that increases between leading edge 74 and trailing edge 76 of fan blade 22. The blade angle of blade 22 at any point along its mean camber line is the angle between a line tangent to the mean camber line at that point and a line perpendicular to a line that intersects both that point and blower wheel axis. For example, the letters "a" and "b" in FIG. 11 represent leading edge and trailing edge blade angles respectively. As shown in FIG. 11, leading edges 74 of blades 22 of blower wheel 14 define an inner diameter 78 (ID) of blower wheel 14 and trailing edges 76 define an outer diameter 80 (OD).

In contrast to the conventional fan blades, fan blades 22 of blower wheel 14 in accordance with the exemplary embodiment has a longer mean camber line length relative to outer diameter 80 of such blower wheel. As a result, the blower wheel 14 has a smaller than typical inner diameter 78 to outer diameter 80 ratio. Preferably, the ratio of the inner diameter 78 of the blower wheel 14 to the outer diameter 80 of the blower wheel 14 is at most 0.85. Alternatively, blower wheel 14 includes any ratio of the inner diameter 78 to the outer diameter 80 to facilitate operation of blower wheel 14 as described herein.

The longer mean camber line length allows the blade angle at the leading edge 74 of each fan blade 22 to be relatively small without impacting the overall pressure generation capabilities of the fan blade 22. The reduced blade angle at the leading edges 74 of the fan blade 22 decreases the incidence angle of air as the air enters the spaces between the fan blades 22 and, combined with other aspects discussed herein, thereby improves the efficiency of the blower wheel 14. Preferably, the blade angle at the leading edge 74 of each fan blade 22 is between approximately 30 degrees and approximately 77 degrees. More preferably, the blade angle at the leading edge 74 of each fan blade 70 is between approximately 40 and approximately 55 degrees (with the nominal being 47 degrees for maximum efficiency). For blower wheels having an outer diameter of between eight and twelve inches, the fan blades are preferably configured such that:

$$0 < \frac{[90 - \alpha(\text{at leading edge})[[C(\text{in.}) - 1.09][ID(\text{in.})]}{\alpha(\text{at leading edge})[OD(\text{in.})]} < 4$$

For blower wheels having an outer diameter ranging from twelve to fifteen inches, the fan blades are preferably configured such that:

$$0 < \frac{[90 - \alpha(\text{at leading edge})[[C(\text{in.}) - 1.37][ID(\text{in.})]}{\alpha(\text{at trailing edge})[OD(\text{in.})]} < 4$$

Figure 12:
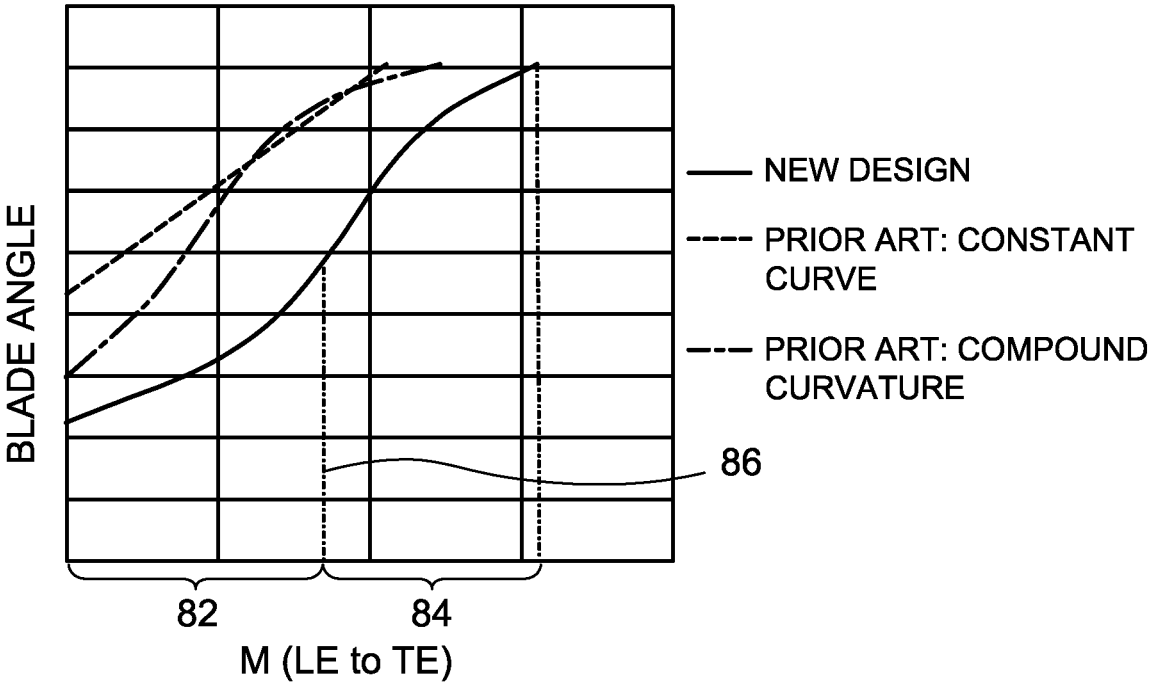
FIG. 12 is a graph of the blade angle of blower wheels as a function of the distance along a mean camber line from the leading edge of the blower wheel blades.
Figure 13:
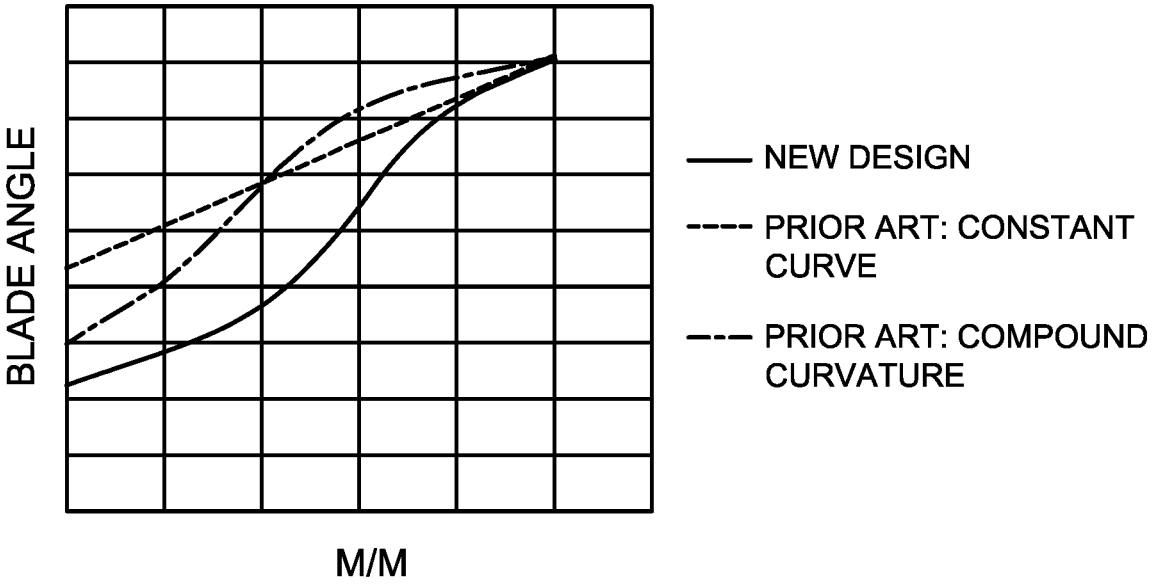
FIG. 13 is a similar graph of blade angle, but as a function of the ratio of distance along the mean camber line from the leading edge to the total length of the mean camber line.

As is shown graphically in FIG. 12, from the leading edge 74 of each fan blade 22, the blade angle of the fan blade 22 preferably increases at an increasing rate throughout a first region 82 of the mean camber line until reaching an inflection point 86 (in FIG. 12, "M" represents the distance along the mean camber line of the fan blade 22 from the leading edge 74 to the trailing edge 76). The blade angle of the fan blade 22 increases at a decreasing rate throughout a second region 84 of the mean camber line, which preferably extends from the inflection point 86 to the trailing edge 76 of the fan blade. FIG. 13 shows the blade angle change in a similar manner except that the x-axis shows M over the total length of the mean camber line. As is apparent from FIGS. 12 and 13, the inflection point 86 preferably lies more than halfway along the mean camber line from the leading edge 74 to the trailing edge 76. More preferably, the inflection point 86 lies between 0.5 and 0.6 times the length of the mean camber line along the mean camber line from the leading edge 74.

Figure 14:
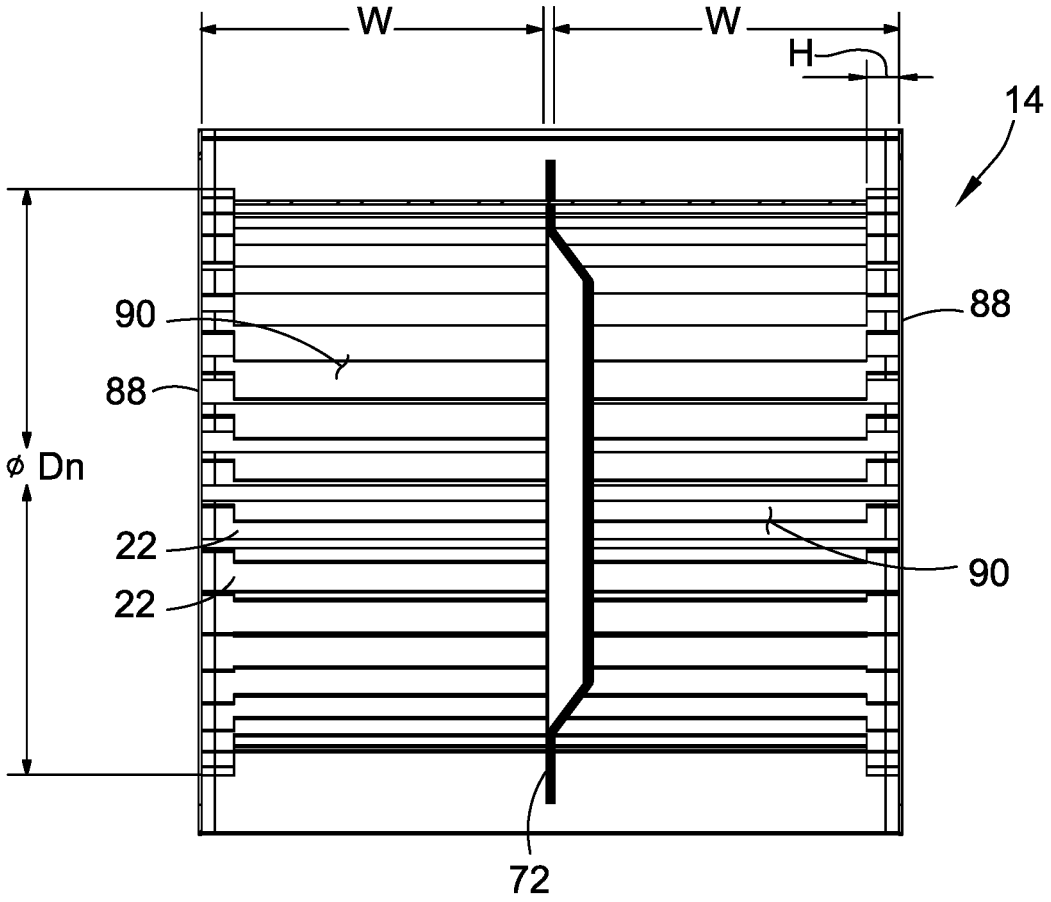
FIG. 14 is a cross-section of the blower wheel shown in FIGS. 10 and 11 taken 90 degrees offset from the cross-section of FIG. 11.

Referring to FIG. 14, blower wheel 14 includes at least one blower wheel inlet 88 and at least one internal cavity 90. Air enters the internal cavity 90 axially through the blower wheel inlet 88 and eventually turns radially outward between the fan blades 22. The internal cavity 90 extends axially from the blower wheel inlet 88 (which is coplanar to axial ends of the fan blades 70) to a divider or end member 72. The width of the internal cavity 90 is the distance between the respective blower wheel inlet 88 and the divider or end member 72 (shown as dimension "W" in FIG. 14). For dual inlet blower wheels, the divider member 72 may or may not be positioned centrally between the axial ends of the blower wheel 14. Thus, it should be appreciated that a blower wheel 14 may have first and second internal cavities 90 of unequal width, and a single inlet blower wheel 14 only comprises one internal cavity 90.

Figure 15:
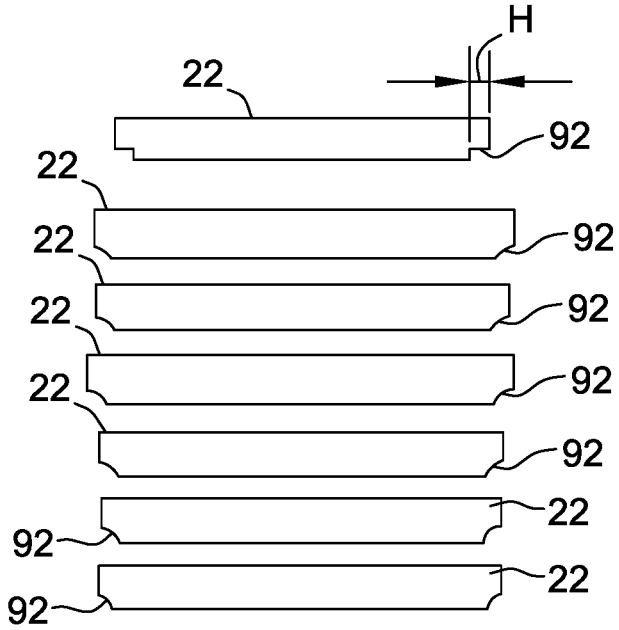
FIG. 15 shows various configurations of leading notches provided on fan blades of the blower wheel shown in FIG. 10.
Figure 16:
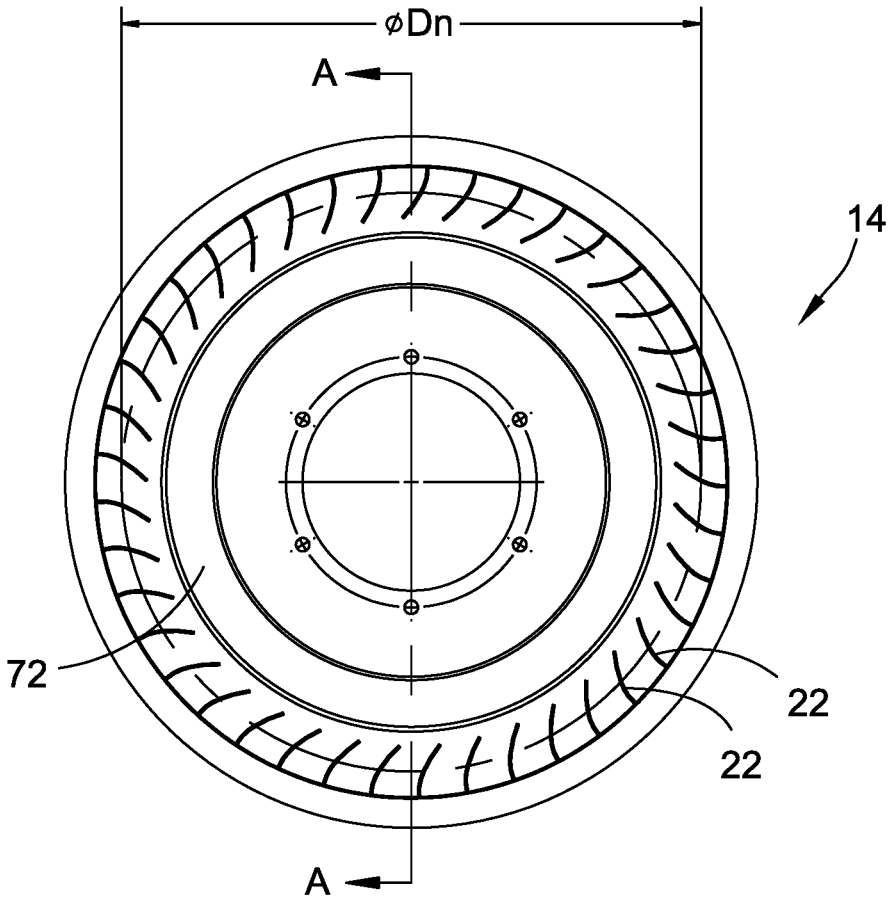
FIG. 16 is a side view of the blower wheel shown in FIGS. 10 and 11.

Blower wheel 14 in accordance with the invention also comprises leading edge notches 92 (shown in FIGS. 10, 14, and 15) in the fan blades 22 adjacent each blower wheel inlet 88. Preferably all of the fan blades 22, or at least a majority of the fan blades, have leading edge notches 92. As shown in FIG. 15, the leading edge notches 92 can have a variety of shapes. However, the leading edge notches 92 are preferably rectangular. As shown in FIG. 16, the leading notches 92 preferably extend radially outward nearest the blower wheel inlet 88 at most to a diameter shown as "Dn". Preferably the ratio of diameter Dn to the outer diameter 80 of the blower wheel 14 is between 0.8 and 0.9. Each leading edge notch 92 has an area greater than 0.045 and less than 0.64 times the square of the chord length within a distance equal to 25% of the axial width of the internal cavity 90 from the blower wheel inlet 88. It should be understood and appreciated from the foregoing that the total area of leading edge notch 92 could extend beyond 25% of the axial width of the internal cavity 90 from the blower wheel inlet 88, so long as the portion of the notch within 25% of the axial width of the internal cavity from the blower wheel inlet 88 has an area greater than 0.045 and less than 0.64 times the square of the chord length. Preferably however, the leading edge notches 92 lie entirely within 25% of the axial width of the internal cavity 90 from the blower wheel inlet 88.

The leading edge notches 92 provided on the fan blades 22 adjacent the blower wheel inlet(s) provide a significant contribution to the efficiency and overall performance of the blower wheels described herein because they stabilize the blower wheels and allow such blower wheels to be operated with non-reduced diameter blower housing inlets. It should be appreciated that air flow direction at the blower wheel inlet is largely axial and lacks any appreciable radial component when not used in combination with inlet rings 16 and 52. In the absence of the notches, such flow could cause undesirable turbulence and even buffeting as such flow strikes the long chord fan blades described herein (especially if the fan blades have a low leading edge blade angle). By providing the fan blades with the leading edge notches adjacent the blower wheel inlet, the fan blades do not encounter such largely axial air flow. However, further from the blower inlet where the flow has a significant radial component, the fan blades are able to take full advantage of having of the low leading edge blade angles. These advantages allow blower wheels in accordance with the invention to be utilized in blower housings having one or more blower housing inlet(s) of larger diameter than would be possible or practical if the fan blades lacked the leading edge notches. For example, the invention allows for such blower wheels to be utilized in blower assemblies wherein the diameter of a housing inlet squared divided by the inner diameter of the blower wheel squared is greater than 1.05.

In embodiments that include inlet rings 16 and 52 with pluralities of fins 38 and 56, respectively, fins 38 and 56 direct the airflow into blower wheel 14 in a non-axial direction such that the direction of the relative velocity of the inlet airflow substantially axial. Because the physical direction of the airflow is non-axial, blades 22 of blower wheel 14 include notches 92 smaller than that as described above. Furthermore, notches 92 may be omitted from blades 22 to provide a larger blade surface to interact with the incoming airflow, which increases the efficiency of blower wheel 14.

The blower wheel 14 shown in FIGS. 10-16 is a single-piece symmetric blower wheel configured for use in a dual inlet blower assembly. Its fan blades 22 extend the full width of the blower wheel 14 and the blower wheel 14 includes a centrally positioned divider member 72. As such, the symmetrical blower wheel 14 shown in FIGS. 10-16 includes two blower wheel inlets 88, two internal cavities 90, and a single set of fan blades 22. Leading edge notches 92 are provided on the fan blades 22 adjacent both blower wheel inlets 88. In other embodiments, the blower wheel 14 is asymmetrical and includes two sets of fan blades that are axial adjacent each other and that are connected to a divider member. By having two sets of fan blades, the set of fan blades encircling one of the internal cavities of the blower wheel can have a different fan blade configuration than those of the other set of fan blades. More specifically, one set of fan blades can define a smaller internal diameter (and hence, smaller diameter of the respective internal cavity) than does the other set of fan blades. This can improve blower efficiency in situations where a blower motor or the structure connecting a motor to support structure (e.g., to the blower housing) limits the innermost diameter of the fan blades on one axial side of a dual inlet blower wheel. This can also improve blower efficiency in situations where the flow air provided to one of the opposite axial sides of the blower wheel is restricted upstream (for example, by the blower housing) in comparison to flow of air provided to the other side of the blower wheel.

Regardless of whether blower wheel 14 includes one or two sets of blades or whether two sets of blades of a blower wheel are configured to define identical inner diameters, each set of fan blades preferably has a solidity that falls within a range of 1.0 to 2.0. The solidity of a blower wheel is defined as the chord length of the fan blades of set of fan blades multiplied by the number of fan blades of that set, divided by the product of the outer diameter of the set of fan blades multiplied by pi. Even more preferably, the solidity of any given set of fan blades falls within the range of 1.25 to 1.75. Thus, it should be appreciated that for asymmetric dual inlet blower wheels having sets of fan blades of that define appreciably different internal diameters, the number of fan blades of one set of fan blades is preferably different than the number of fan blades of the other set, so as to a achieve the desired solidity for each of the sets of fan blades.

The apparatus, methods, and systems described herein provide a centrifugal blower assembly having increased efficiency, reduced noise, and an improved airflow distribution at the blower outlet opening. Specifically, the centrifugal blower assembly described herein includes an inlet ring having a plurality of circumferentially-spaced fins. These fins change the direction of the airflow entering the inlet of the blower wheel to increase the efficiency of the blower wheel. More specifically, the inlet ring fins change the direction of the airflow such that the direction of the relative velocity of the airflow matches the direction of the blower wheel blades with respect to the axis of rotation. Aligning the relative velocity of the airflow entering the blower wheel with the direction of the blower wheel blades enables the blower wheel to interact with a maximum amount of air and channel more air through the outlet.

Exemplary embodiments of the centrifugal blower are described above in detail. The centrifugal blower and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inlet ring for use in a centrifugal blower assembly including an axis of rotation, said into ring comprising:

a ring portion comprising a first end, a second end, and a ring body extending therebetween; and a plurality of fins coupled to said ring body, wherein said plurality of fins are circumferentially-spaced about said ring body, and wherein each fin of said plurality of fins comprises a leading edge, a trailing edge, and a fin body extending therebetween, wherein said leading edge includes a first length and said trailing edge includes a second length shorter than said first length, wherein said plurality of fins comprises a number of fins equal to $$\frac{(\pi S(ID))}{C},$$

wherein S is a solidity of each of said plurality of fins, ID is an inner diameter of said inlet ring, and C is a chord length of each of said plurality of fins.

2. The inlet ring in accordance with claim 1, wherein said fin body is planar between said leading edge and said trailing edge.

3. The inlet ring in accordance with claim 2, wherein said fin body is oriented at an angle within a range of 0 degrees and 60 degrees with respect to said rotational axis.

4. The inlet ring in accordance with claim 3, wherein said fin body is oriented at an angle within a range of 20 degrees and 30 degrees with respect to said rotational axis.

5. The inlet ring in accordance with claim 1, wherein said fin body is curved between said first end and said second end.

6. The inlet ring in accordance with claim 5, wherein said fin body defines the chord length between said first end and said second end.

7. The inlet ring in accordance with claim 6, wherein said chord length is oriented at an angle within a range of 20 degrees and 30 degrees with respect to said rotational axis.

8. A centrifugal blower assembly comprising:

a housing;

an inlet ring;

a blower wheel coupled to said housing and comprising a plurality of blades circumferentially-spaced about an axis of rotation, wherein each blade comprises a length and is oriented at a first angle along the length with respect to the rotational axis; and a plurality of circumferentially-spaced fins coupled in flow communication with said blower wheel, said plurality of fins configured to direct an inlet airflow into said blower wheel such that a relative velocity direction of the inlet airflow is oriented at the first angle with respect to the rotational axis, wherein each fin of said plurality of fins further comprises a fin radially inner edge extending between a leading edge and a trailing edge of said each fin, wherein said fin radially inner edge is exposed to the inlet airflow, wherein said plurality of fins comprises a number of fins equal to $$\frac{(\pi S(ID))}{C},$$

wherein S is a solidity of each of said plurality of fins, ID is an inner diameter of said inlet ring, and C is a chord length of each of said plurality of fins.

9. The centrifugal blower assembly in accordance with claim 8, wherein said first angle is parallel to the rotational axis.

10. The centrifugal blower assembly in accordance with claim 8, wherein each blade of said plurality of blades comprises a blade radially inner edge that defines an inner diameter of said blower wheel, and wherein said fin radially inner edge that defines an inner diameter of said plurality of fins that is greater than the inner diameter of said blower wheel.

11. The centrifugal blower assembly in accordance with claim 8, wherein each fin of said plurality of fins comprises a fin body extending between said leading edge and said trailing edge, wherein said fin body is planar between said first end and said second end, wherein said fin body is oriented at an angle within a range of 20 degrees and 30 degrees with respect to said rotational axis.

12. The centrifugal blower assembly in accordance with claim 8, wherein said inlet ring coupled to said housing such that said inlet ring defines a housing inlet, wherein said plurality of fins are coupled to said inlet ring.

13. The centrifugal blower assembly in accordance with claim 8, wherein a fin body is curved between a first end and a second end, wherein said fin body defines the chord length between said first end and said second end, and wherein said chord length is oriented at an angle within a range of 20 degrees and 30 degrees with respect to said rotational axis.

14. The centrifugal blower assembly in accordance with claim 8, wherein said plurality of fins are coupled to said housing.

15. A method of assembling a centrifugal blower assembly, said method comprising:

coupling a blower wheel to a housing, wherein the blower wheel includes a plurality of blades circumferentially-spaced about an axis of rotation, wherein each blade includes a length and is oriented at a first angle along the length with respect to the rotational axis;

coupling an inlet ring to the housing such that the inlet ring defines a housing inlet; and coupling a plurality of circumferentially-spaced fins about the inlet ring such that the plurality of fins are configured to direct an inlet airflow into the blower wheel, wherein the inlet airflow includes a relative velocity direction oriented at the first angle with respect to the rotational axis, wherein said plurality of fins comprises a number of fins equal to $$\frac{(\pi S(ID))}{C},$$

wherein S is a solidity of each of said plurality of fins, ID is an inner diameter of said inlet ring, and C is a chord length of each of said plurality of fins.

16. The method in accordance with claim 15, wherein coupling the plurality of fins comprises coupling the plurality of fins to the inlet ring such that the first angle of the inlet airflow relative velocity is parallel to the rotational axis.

17. The method in accordance with claim 15, wherein coupling the plurality of fins comprises coupling the plurality of fins such that the plurality of fins are oriented at an angle within a range of 0 degrees and 60 degrees with respect to the rotational axis.

18. The method in accordance with claim 15, wherein coupling the plurality of fins comprises coupling a plurality of fins that are planar between opposing ends.

19. The method in accordance with claim 15, wherein coupling the plurality of fins comprises coupling a plurality of fins that are curved between opposing ends.

* * * * *